US009067652B2

(12) United States Patent
Nanayakkara et al.

(10) Patent No.: US 9,067,652 B2
(45) Date of Patent: Jun. 30, 2015

(54) SURFBOARD WITH SAFETY MECHANISM

(71) Applicants: Lakdas Nanayakkara, Boca Raton, FL (US); Pravin Nanayakkara, Boca Raton, FL (US)

(72) Inventors: Lakdas Nanayakkara, Boca Raton, FL (US); Pravin Nanayakkara, Boca Raton, FL (US)

( * ) Notice: Subject to any disclaimer, the term of this patent is extended or adjusted under 35 U.S.C. 154(b) by 0 days.

(21) Appl. No.: 14/031,394

(22) Filed: Sep. 19, 2013

(65) Prior Publication Data

US 2015/0079860 A1 Mar. 19, 2015

(51) Int. Cl.
*B63H 16/20* (2006.01)
*B63B 35/79* (2006.01)

(52) U.S. Cl.
CPC ..... *B63B 35/79* (2013.01); *B63H 16/20* (2013.01)

(58) Field of Classification Search
CPC ..... B63H 16/20; B63B 35/79
USPC ..... 441/65, 74, 79; 440/21, 26, 27; 114/312, 313, 315, 337, 338
See application file for complete search history.

(56) References Cited

U.S. PATENT DOCUMENTS

| | | | | | |
|---|---|---|---|---|---|
| 1,640,390 | A | * | 8/1927 | Bacon | 440/27 |
| 3,180,306 | A | * | 4/1965 | Gouedy | 440/26 |
| 3,585,960 | A | * | 6/1971 | Shuler | 440/91 |
| 3,779,202 | A | * | 12/1973 | Martin et al. | 114/283 |
| 3,874,319 | A | * | 4/1975 | Martin et al. | 440/27 |
| 4,321,048 | A | * | 3/1982 | Marchese et al. | 440/32 |
| 4,389,195 | A | * | 6/1983 | Sohaei | 440/15 |
| 4,698,033 | A | * | 10/1987 | Hall | 440/27 |
| 4,752,262 | A | * | 6/1988 | Martinmaas | 441/79 |
| 6,033,276 | A | * | 3/2000 | Han | 441/135 |
| 7,699,017 | B1 | * | 4/2010 | Marshall | 114/315 |

* cited by examiner

*Primary Examiner* — Daniel V Venne
(74) *Attorney, Agent, or Firm* — Melvin K. Silverman

(57) ABSTRACT

A surfboard for supporting a surfer to swim on or below surface of water includes a supporting body having an upper surface, a lower surface, a leading edge and a trailing edge. The leading edge including a protrusion contoured for supporting the surfer's face and the upper surface to support the surfer. The surfboard also includes a cover plate mounted on the lower surface underneath the leading edge, a propeller mounted on the lower surface underneath the leading edge, a steering system mounted on the lower surface underneath the leading edge, and a safety enclosure for protecting face of the surfer. The surfboard may be provided with wings extensible from the sides of the body to provide support and stability to surfers of larger size.

6 Claims, 6 Drawing Sheets

SURFBOARD WITH SAFETY MECHANISM

FIELD OF THE INVENTION

The present invention generally relate to marine recreational devices, and, particularly, to surfboards for supporting a surfer to advance on or below the surface of water.

BACKGROUND OF THE INVENTION

It is well known to use various equipments that are available for recreational activities in water. Generally, while using recreational sporting equipment, the individual user lies flat on the top surface and extends his arms to a set of pedals. As the user rotates the pedals, a means of propulsion under the surface of the water is activated. The means of propulsion provides the ability to move the device in the water, as appropriate mechanical linkage between the pedals and the means of propulsion is provided.

A major disadvantage of such recreational equipments, however, is that they do not provide any protection to the user's face when the user is in an appropriate posture on the top surface of the equipment.

Accordingly, there remains a need in the art for improved recreational sporting equipment which solves the problems encountered while using the previously known devices and provides the required protection to user's face when the user rides on the device in or on the surface of water.

The prior art as is known to the Inventor is reflected in U.S. Pat. No. 4,698,033 to Hall.

SUMMARY OF THE INVENTION

In accordance with an embodiment of the present invention, a surfboard for supporting a surfer to swim on or below the surface of water includes a supporting body having an upper surface, a lower surface, a leading edge and a trailing edge. Particularly, the leading edge has a protrusion contoured for supporting the surfer's face and the upper surface is adapted to support the surfer. The surfboard further includes a cover plate mounted on the lower surface underneath the leading edge of the supporting body along a longitudinal central axis of the supporting body, wherein the cover plate has a first edge and a second edge. The surfboard further includes a propeller mounted on the lower surface underneath the leading edge of the supporting body, and a steering system mounted on the lower surface underneath the leading edge of the supporting body. Particularly, the steering system includes a first crank arm and a second crank arm.

The surfboard further includes a central fin mounted underneath the second edge of a cover plate, and steering fins a pair of fins stationary mounted underneath the trailing edge of the supporting body. The steering system is mounted on the leading edge of the supporting body via a pair of mounting brackets. The propeller is positioned between the pair of mounting brackets and the propeller is operably engaged to the first crank arm and the second crank arm. The first crank arm passes through a first aperture of a first mounting bracket of the pair of mounting brackets and through an orifice of the propeller. Similarly, the second crank arm passes through a second aperture of a second mounting bracket of the pair of mounting brackets and through the orifice of the propeller. The surfboard further includes a safety mechanism for protecting face of the surfer. The safety mechanism includes a safety glass and a safety shield, and the safety glass is contoured to fit into the protrusion of the supporting body. The safety shield is mounted on periphery of the upper surface above the leading edge of the supporting body. The steering system further includes a first hand grip portion and a second hand grip portion. Particularly, the first hand grip portion is mounted on the first crank arm and the second hand grip portion is mounted on the second crank arm, and the first hand grip portion and second hand grip portion provide a grip to the surfer's hand.

Extensible wings may be provided at the sidewalls of the surfboard to accommodate surfers of larger size.

An object of the present invention is to provide an improved, manually propelled recreational watercraft of light weight and simple construction.

It is a further object of the present invention is to provide a manually propelled personal watercraft that provides comfort for the rider.

It is another object of the present invention to provide a manually propelled personal watercraft which has stability in the water.

It is a further object to provide a manually propelled personal watercraft which is easy to operate and inexpensive to produce.

The above and further objects of the present invention will become apparent in the attached description and appended claims.

DETAILED DESCRIPTION OF THE INVENTION

Figure 1:
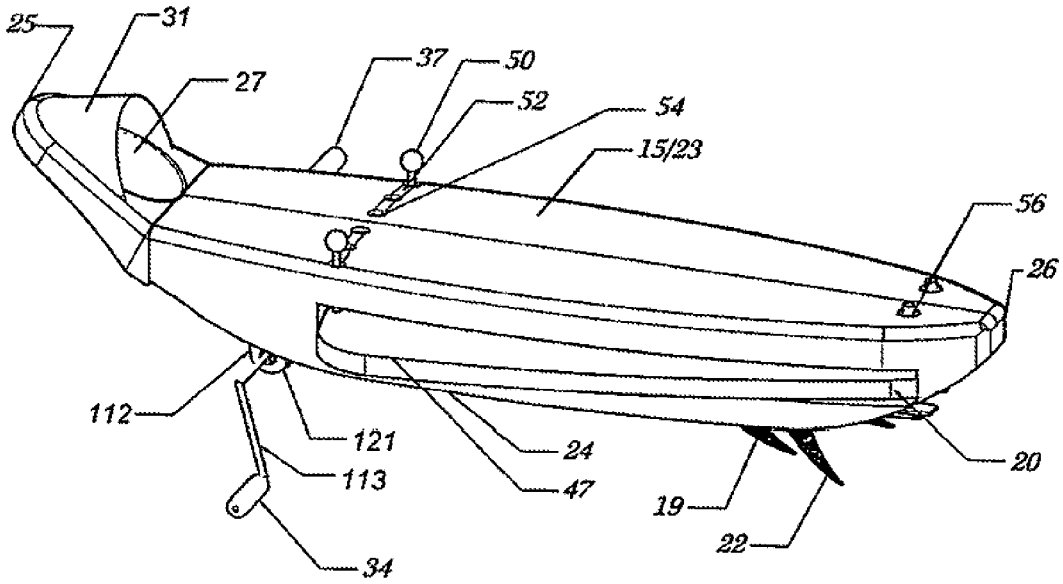
FIG. 1 is a perspective view of a surfboard for supporting a surfer to swim on or below the surface of water, according to an embodiment of the invention.
Figure 2:
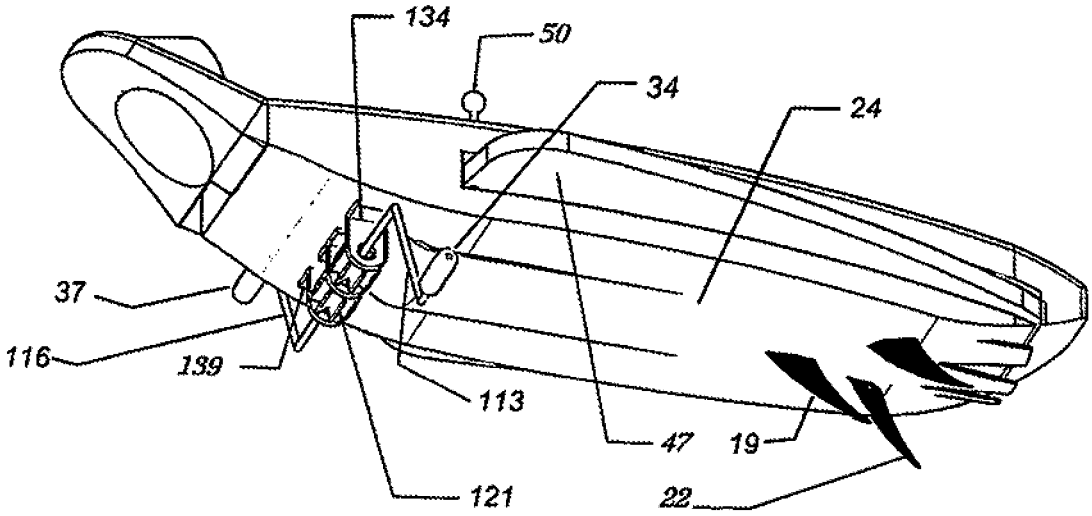
FIG. 2 is a perspective bottom view of the surfboard for supporting the surfer to swim on or below surface of water, according to the embodiment of FIG. 1

With reference to FIGS. 1-2 is shown a first embodiment of a surfboard for supporting a surfer to swim on or below surface of water includes a supporting body 15 having an upper surface 23, a lower surface 24, a leading edge 25 and a trailing edge 26. Particularly, the leading edge 25 has a partial cover 31 and opening 27 contoured for supporting the surfer's face within the opening and the upper surface 23 is adapted to support the surfer. In use, the surfer may use the cover 31 to position his or her face, as described hereinbelow. Additionally, the leading edge 25 coincides with the surfer's face, while the trailing edge 26 of the supporting body 15 coincides with the surfer's feet.

Figure 3:
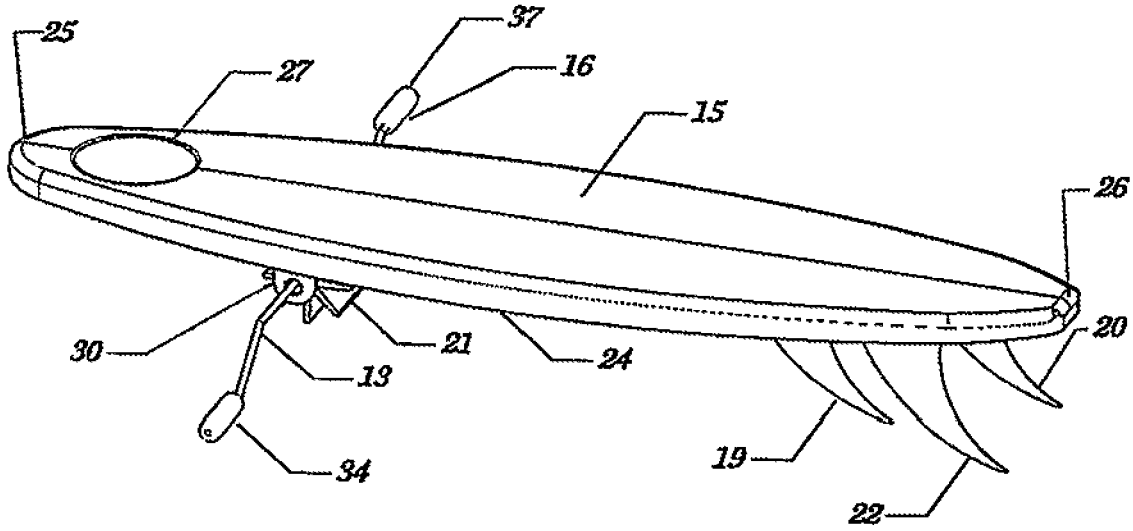
FIG. 3 is a top view of the surfboard for supporting the surfer to swim on or below surface of water, according to a second embodiment of the invention.
Figure 4:
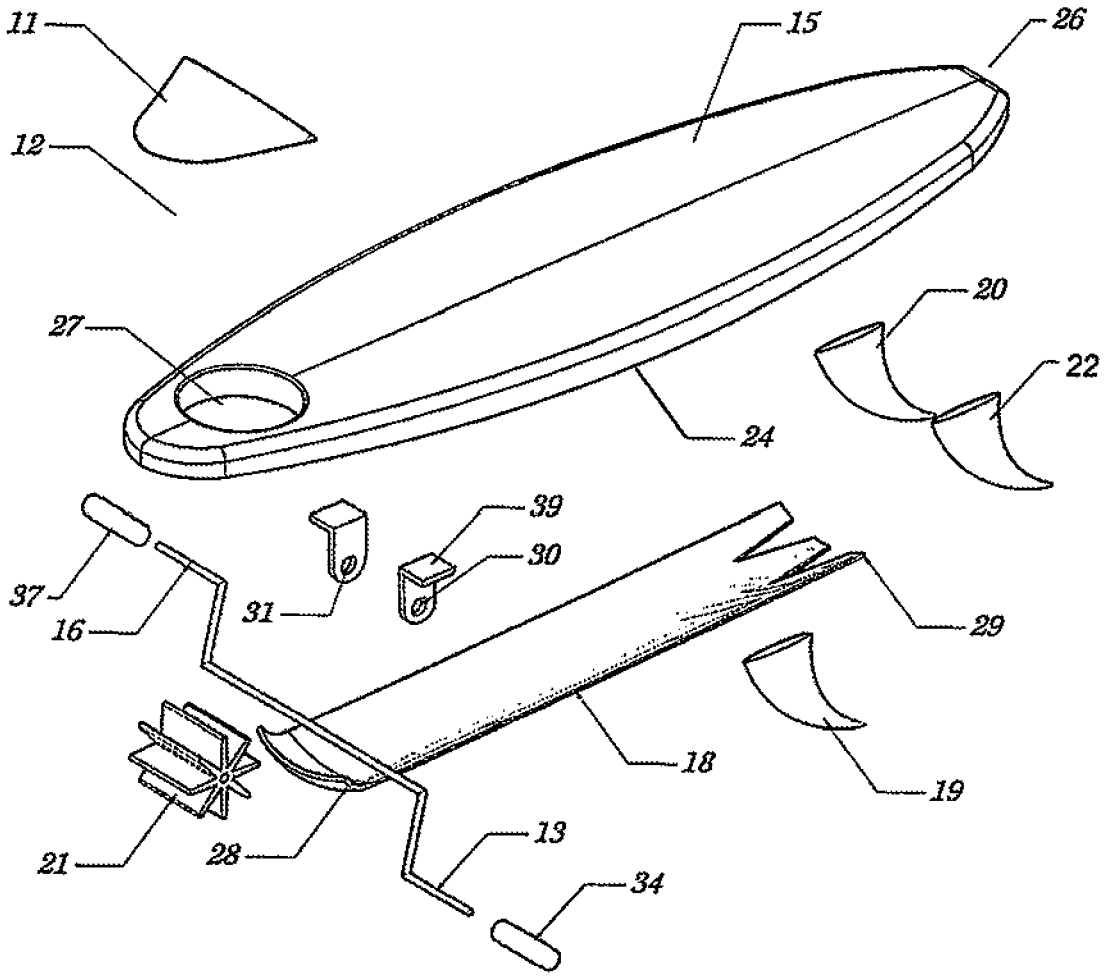
FIG. 4 is an exploded view of the embodiment of FIG. 3.
Figure 5:
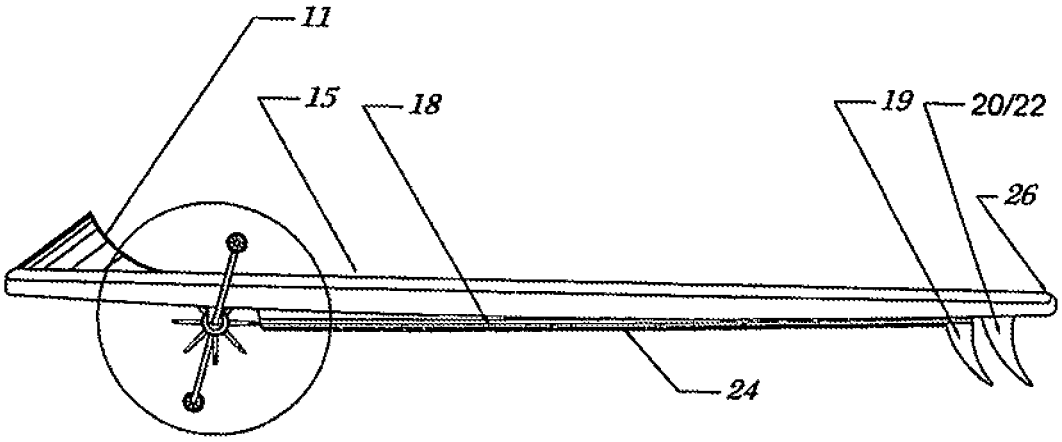
FIG. 5 is a side elevation and details of the surfboard for supporting the surfer to swim on or below surface of water, according to the embodiment of FIG. 3.
Figure 6:
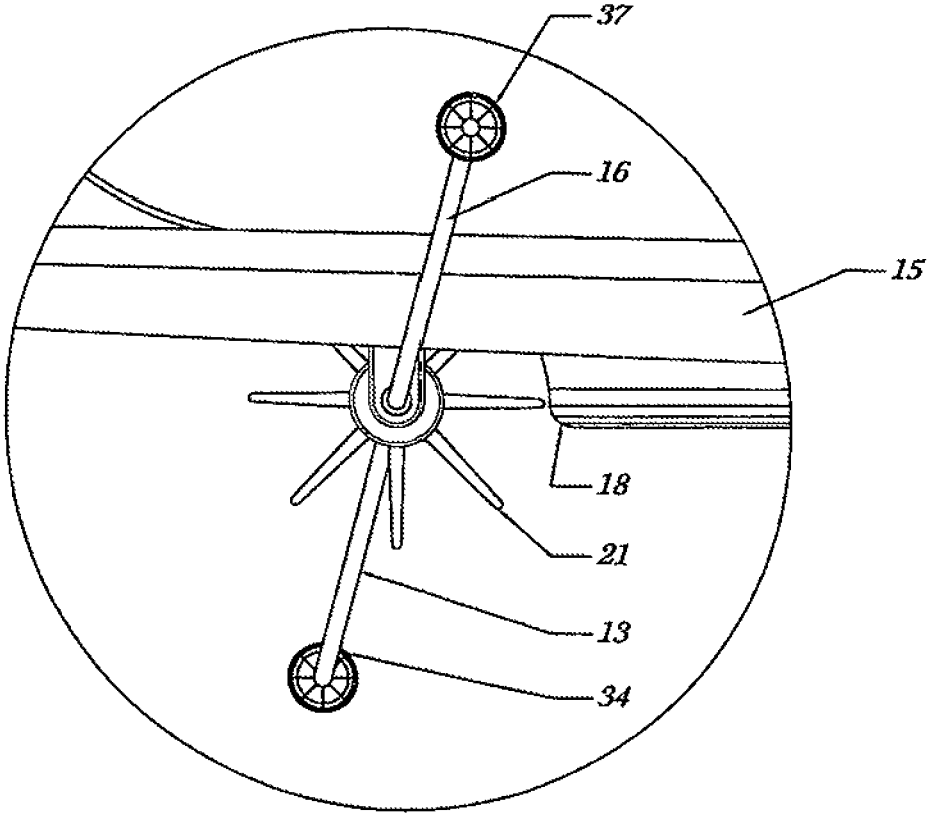
FIG. 6 is an enlarged view of the handle and sprocket portion of FIG. 5.
Figure 7:
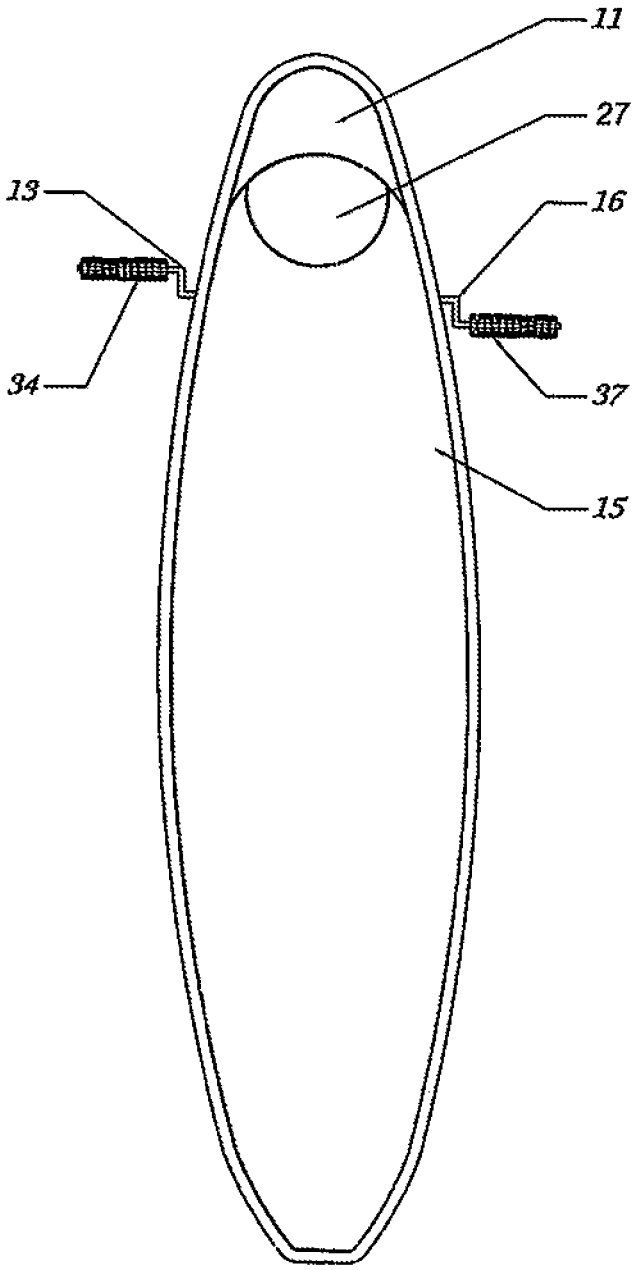
FIG. 7 is a top view of the surfboard according to the embodiment of FIG. 3.

Furthermore, the surfboard further includes propellers 112 mounted on the lower surface underneath the leading edge of the supporting body 15, and a steering system 132 mounted on the lower surface underneath the leading edge of the supporting body 15. The steering system includes a first crank arm 113 and a second crank arm 116. In use, the first crank arm and like second crank arm are used by the surfer as pedals that are operated with the surfer's arms to operate a propeller 121, using the steering system, as described hereinbelow. See FIGS. 3-5.

In accordance with an embodiment of FIGS. 1 and 2, the surfboard further includes wings 47 mounted slidably extensibly from sides 49 of body 15, the outward extent of which is controlled by handles 50 and selectable positions 52 and 54 thereof.

In use, the steering system, as disclosed hereinabove, is mounted near the leading edge of the supporting body 15 via a pair of mounting brackets 139 and the propellers 121 positioned between the mounting brackets in a manner enabling the propellers to be operably engaged to the first crank arm 113 and the second crank arm 116. Moreover, the crank arms 113 passes initially through a first aperture of mounting brackets 134 and further pass through a channel within the propeller 121. In a similar manner, the second crank arm 116 initially passes through a second aperture of a mounting bracket of the pair of mounting brackets 139, and further passes through a channel of the propeller 121.

In accordance with all embodiments of the invention, the surfboard further includes a safety glass upon opening 27 and said safety shield 31. Particularly, the safety glass is contoured to fit into the opening 27 of the supporting body 15. The safety shield is mounted on periphery of the upper surface above the leading edge 25 of the supporting body 15. Generally, the safety glass 12 is a tempered glass.

In accordance with an embodiment of the present invention, the tempered glass surface of the safety glass is scratch resistant. However, those of ordinary skill in the art will appreciate that any other type of safety glass may also be employed to provide protection to the surfer's face.

FIGS. 3-7 show an embodiment of the invention which does not include extensible wings 47.

The steering system further includes a first hand grip portion 34 and a second hand grip portion 37 (see FIGS. 3-7) for providing an appropriate grip to the surfer's hand while using the surfboard. Generally, the first hand grip portion 34 is mounted on the first crank arm 13 and the second hand grip portion 37 is mounted on the second crank arm 16, in a manner such that the first hand grip portion 34 and second hand grip portion 37 provide the required grip to the surfer's hand when the surfer pedals the first crank arm 13 and the second crank arm 16 by using the steering system, as described above. Lower surface 18 provides a desired fluid dynamic lower surface 24 to body 15 of the surfboard. Openings 29 act to secure control fin 19 and stationary rear fins 21/22 to body 15. See FIGS. 4 and 5.

Therefore, as may be seen, the present invention provides a recreational surfboard with a safety mechanism for protecting surfer's face against high tides of water. Also, as described hereinabove, the surfboard provides a convenient steering mechanism employing crank arms with gripping handles whereby the surfer is able to swim in water by pedaling with his or her arms.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

The invention claimed is:

1. A surfboard for supporting a surfer to swim on or below a surface of water, the surfboard comprising:

(a) a supporting body having an upper surface, a lower surface, a leading edge and a trailing edge, said leading edge having a protrusion contoured for supporting and protecting a face of said surface and surface;

(b) a steering system including a propeller mounted on said lower surface underneath said leading edge of said supporting body, said steering system comprising a first crank arm and a second crank arm, both journalled within said propeller, each arm having an handle, in which said steering system is mounted proximally to said leading edge of said supporting body by mounting brackets, in which said propeller is positioned within a pair of mounting brackets and said propeller is operably engaged to said first crank arm and said second crank arm;

(c) a control fin mounted underneath said supporting body; and (d) a pair of stationary fins mounted underneath said trailing edge of said supporting body.

2. The surfboard as claimed in claim 1, wherein said crank arms pass through apertures of said mounting brackets and through an orifice within said propeller.

3. The surfboard as claimed in claim 1, wherein said safety mechanism comprises a safety glass and a safety shield, said safety glass contoured to fit into said protrusion of said supporting body.

4. The surfboard as claimed in claim 1, wherein said surfboard further comprises an enclosure for protecting the face of said surfer.

5. The surfboard as claimed in claim 1, wherein said steering system further comprises:

a first hand grip portion and a second hand grip portion, said first hand grip portion being mounted on said first crank arm and said second hand grip portion being mounted on said second crank arm, and said first hand grip portion and second hand grip portion providing a grip to said surfer's hand.

6. The surfboard as recited in claim 4 further including wings extensible from said lateral sides of said supporting body having respective pivot points proximally to a rear of the surfboard, and having controls for operating the degree of extension of said wings by the surfer using the surfboard.

* * * * *